US006389613B1

(12) United States Patent
Comas

(10) Patent No.: US 6,389,613 B1
(45) Date of Patent: May 21, 2002

(54) PRESSURE FLUSH CONTROL SYSTEM

(76) Inventor: James Comas, 23 Barlow Ave., Glen Cove, NY (US) 11542

( * ) Notice: Subject to any disclaimer, the term of this patent is extended or adjusted under 35 U.S.C. 154(b) by 0 days.

(21) Appl. No.: 09/808,595

(22) Filed: Mar. 14, 2001

(51) Int. Cl.[7] ..... B08B 3/02; E03D 9/00

(52) U.S. Cl. ..... 4/255.06; 4/255.04; 15/104.061; 134/166 C; 134/167 C; 134/171

(58) Field of Search ..... 4/255.01, 255.04, 4/255.06, 255.07; 134/167 C, 171, 166 C; 15/104.061

(56) References Cited

U.S. PATENT DOCUMENTS

| | | | | |
|---|---|---|---|---|
| 1,848,269 A | | 3/1932 | Petersen | 134/167 C X |
| 2,273,984 A | | 2/1942 | Osborn | 134/167 C X |
| 2,753,876 A | | 7/1956 | Kurt | 134/167 C |
| 3,075,535 A | | 1/1963 | Lasting | 134/167 C |
| 3,086,540 A | * | 4/1963 | Anderson | 134/167 C |
| 3,714,951 A | | 2/1973 | Lundman | 134/167 C |
| 5,086,842 A | | 2/1992 | Cholet | 134/167 C X |

FOREIGN PATENT DOCUMENTS

| | | | |
|---|---|---|---|
| WO | WO 94/08105 | * | 4/1994 |

* cited by examiner

*Primary Examiner*—Gregory Huson
*Assistant Examiner*—Kathleen J. Prunner
(74) *Attorney, Agent, or Firm*—Collard & Roe, P.C.

(57) ABSTRACT

A pressure flush control system comprises a hose connected at one end to a water supply and an inflatable bag connected to the other end of the hose, so that water from the water supply flows through the hose and into the bag to inflate the bag after the hose and bag are inserted into a drain pipe to keep the system mounted in the pipe during use. There is a second hose extending through the bag from an input side to an output side. The second hose is connected on the input side to a pressurized source of water, so that water from the pressurized source flows through the second hose to the output side under high pressure to clean the walls of the pipe. There is a third hose extending through the bag from the input side to the output side so that water exiting from the second hose returns through the third hose to the input side of the bag. There is also a valve connected to the third hose for closing the third hose to prevent water flow through the third hose. This allows water pressure to build up on the output side of the bag to clear clogs in the pipe.

8 Claims, 1 Drawing Sheet

PRESSURE FLUSH CONTROL SYSTEM

BACKGROUND OF THE INVENTION

1. Field of the Invention

This invention relates to a pressure flush control system for cleaning sewer pipes and clearing clogs in the pipes. In particular, the invention relates to a system that uses a jet hose to clean the pipe walls and allows the flushing water to drain back out of the pipe during the washing operation.

2. The Prior Art

Many devices have been proposed for cleaning and flushing sewer pipes. One of the more common devices consists of an inflatable bag through which a hose is inserted. The bag is filled with water within the pipe and keeps the hose within the pipe during use. The water from the hose also is used to clean the pipe and/or clear clogs in the pipe. Examples of this type of arrangement are shown in U.S. Pat. No. 3,714,951 to Lundman.

Other similar devices of this type are shown in U.S. Pat. No. 3,075,535 to Lasting, U.S. Pat. No. 2,273,984 to Osborn, U.S. Pat. No. 2,753,876 to Kurt, U.S. Pat. No. 1,848,269 to Petersen, and U.S. Pat. No. 5,086,842 to Cholet. While these devices all provide for cleaning and flushing sewer pipes, they all suffer from several drawbacks, such as not enough water pressure reaching the clogged or dirty areas of the pipes, and no way for the excess water to drain out of the pipe.

SUMMARY OF THE INVENTION

It is therefore an object of the present invention to provide a device for cleaning and flushing sewer pipes that efficiently cleans the pipes using water at high pressure.

It is another object of the invention to provide such a device that allows the excess cleaning water to drain back out of the pipe in the direction from where it came.

It is yet another object of the invention to provide such a device that is simple and inexpensive to manufacture an use.

These and other objects are accomplished by a pressure flush control system comprising a hose connected at one end to a water supply and an inflatable bag connected to the other end of the hose, so that water from the water supply flows through the hose and into the bag to inflate the bag after the hose and bag are inserted into a drain pipe. There is a second hose extending through the bag from an input side to an output side. The second hose is connected on the input side to a pressurized source of water, so that water from the pressurized source flows through the second hose to the output side under high pressure to clean the walls of the pipe. There is a third hose extending through the bag from the input side to the output side so that water exiting from the second hose returns through the third hose to the input side of the bag. The inflated bag keeps the entire system firmly mounted within the pipe during use. The water from the second hose exits under high pressure to clean the walls of the pipe and/or to clear clogs in the pipe. This second hose is preferably a jet hose which is commonly known in the art and not described in detail here. These types of hoses are commercially available, for example from Mustang (see http://www.mustangunits.com).

There is also a valve connected to the third hose for closing the third hose to prevent water from flowing through the third hose. This allows water pressure to build up on the output side of the bag to clear clogs in the pipe. Once the clog is cleared, the valve on the third hose can be opened again to allow the excess water to drain back out. Preferably, this valve is adjustable so that the amount of water flowing back can be regulated.

There is preferably a release valve connected to the first hose for releasing water from the bag to deflate the bag and remove the system from the pipe after use. This first hose is preferably a standard garden hose that is connected to a standard water supply at the job site. Other types of hoses and water supplies could also be used.

So that the bag stays inflated during the entire operation regardless of the operation of the second and third hoses, the bag has two tubes extending through from the input side to the output side for the second and third hoses to be inserted. The interior of the bag is entirely closed to the outside except for its connection to the first hose. This way, water from the second and third hoses does not enter or exit the interior of the bag.

The bag is preferably made of canvas, rubber or synthetic rubber, but any flexible and/or expandable material could also be used.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
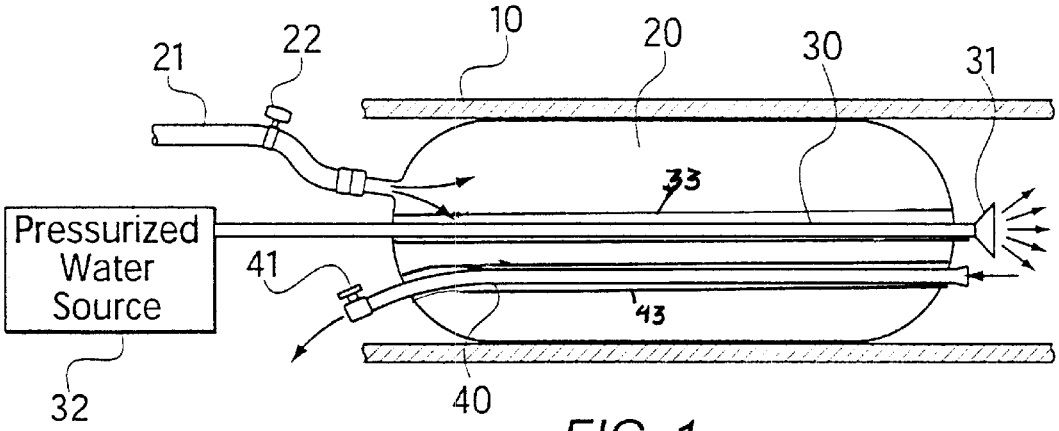
FIG. 1 shows a cross-sectional view of the system according to the invention inserted into a drain pipe.

Referring now in detail to the drawings, FIG. 1 shows the system according to the invention inserted into a pipe 10. The system comprises an inflatable bag 10, which is attached at one end to a standard size garden hose 21. Garden hose 21 is connected to a local water source and fills bag 20 with water to inflate it after bag 20 is inserted into pipe 10. Bag 20 is inflated until it abuts the inner walls of pipe 10, and keeps the system within pipe 10 during use. Bag 20 can be inserted in any location along the length of the pipe.

Figure 2:
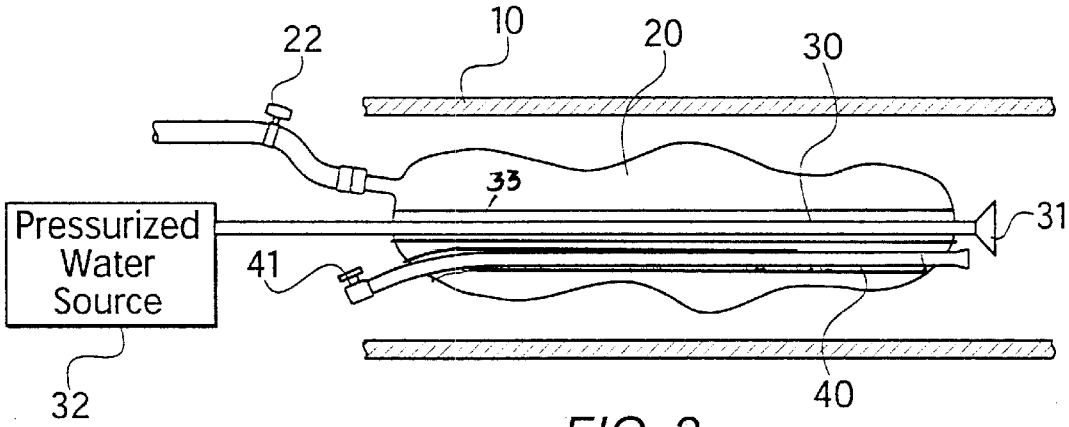
FIG. 2 shows a cross-sectional view as in FIG. 1 but with the bag in a deflated condition.

There is a valve 22 attached to hose 21, which can be used to release the water from bag 20 when the cleaning operation is complete, to move the system to a different location or to remove the system from the pipe. Once the water drains out, bag 20 deflates and can be easily moved within the pipe or removed from it, as shown in FIG. 2.

To clean the inside walls of pipe 10, a second hose 30 extends through bag 20 from an input end to an output end. At the input end, hose 30 is attached to a pressurized source of water 32. At the output end, there is a spray nozzle 31 for spraying the pressurized water against the walls of pipe 10 to clean the walls. Hose 30 is preferably a jet hose, but other types could also be used. Hose 30 preferably extends through a tube 33 in bag 20, so that no water from bag 20 escapes during operation of the system.

To allow water from hose 30 to drain back out of pipe 10, there is a third hose 40 inserted through a tube 43 in bag 10.

As water builds up in pipe 10, it can drain out of hose 40 back where it came from, so that it does not flood any area on the output end. Hose 40 can be any type of hose.

Figure 3:
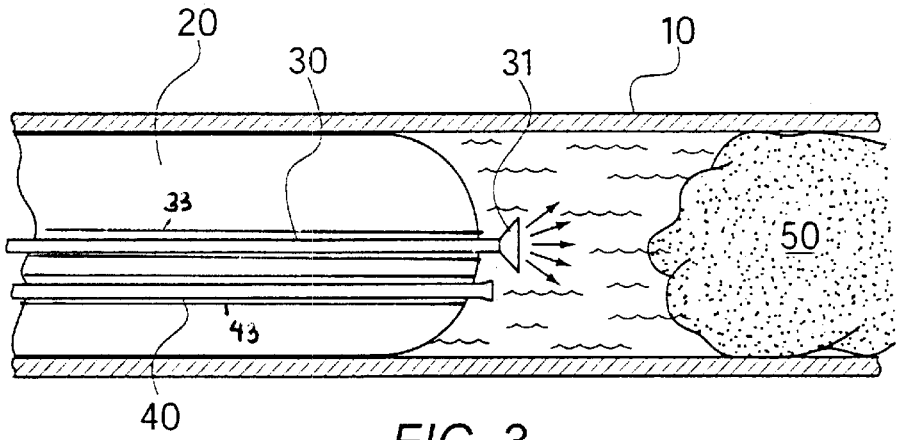
FIG. 3 shows a cross-sectional view of the system according to the invention as it is used to clear a clog in the pipe.

There is a closing valve 41 located on hose 40, as shown in FIGS. 1 and 2, which allows hose 40 to be sealed off to prevent any water from flowing out. The reason for this is in the case of a large clog 50 in pipe 10, as shown in FIG. 3, water from hose 30 can build up behind clog 50 and push it through pipe 10. Once clog 50 is cleared, closing valve 41 can be opened again to allow excess water to drain out.

Accordingly, while only one embodiment of the present invention has been shown and described, it is obvious that many changes and modifications may be made thereunto without departing from the spirit and scope of the invention.

What is claimed is:

1. A pressure flush control system comprising:

a first hose having two ends, one end being connectable to a water supply;

an inflatable bag connected to the other end of said first hose, such that water from the water supply flows through said first hose and into said bag to inflate said bag;

a second hose extending through said bag from an input side to an output side, said second hose being connected on said input side to a pressurized source of water, such that water from said pressurized source flows through said second hose to said output side under high pressure;

a third hose extending through said bag from the input side to the output side, wherein water exiting from said second hose returns through said third hose to the input side of the bag; and a valve on said third hose for closing said third hose to prevent water flow through said third hose.

2. The system according to claim 1, further comprising a release valve on said first hose for releasing water from said bag to deflate said bag.

3. The system according to claim 1, wherein said second hose is a jet hose.

4. The system according to claim 1, wherein said first hose is a standard garden hose.

5. The system according to claim 1, wherein the bag has two tubes extending through from said input side to said output side, and wherein said second and third hoses are inserted through said tubes, such that water from said second and third hoses does not enter or exit the interior of said bag.

6. The system according to claim 1, wherein the bag is made of a material selected from the group consisting of canvas, rubber and synthetic rubber.

7. The system according to claim 1, wherein said valve is adjustable to allow varying amounts of water back through the third hose.

8. The system according to claim 1, wherein there is a nozzle at the output end of the second hose for spraying pressurized water.

* * * * *